US007131872B1

(12) United States Patent
Lee et al.

(10) Patent No.: US 7,131,872 B1
(45) Date of Patent: Nov. 7, 2006

(54) MODULAR JACK CONNECTOR HAVING ANTI-MISMATING ELEMENT

(75) Inventors: Chih-Peng Lee, Tu-Cheng (TW); Kai-Hsiang Chang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 71 days.

(21) Appl. No.: 11/254,493

(22) Filed: Oct. 20, 2005

(51) Int. Cl.
*H01R 13/64* (2006.01)

(52) U.S. Cl. ..... 439/677

(58) Field of Classification Search ..... 439/624, 439/633, 607, 676, 677, 680, 681
See application file for complete search history.

(56) References Cited

U.S. PATENT DOCUMENTS 6,935,900 B1 * 8/2005 Wan et al. ..... 439/677
6,957,984 B1 * 10/2005 Huang ..... 439/676
6,966,798 B1 * 11/2005 Wu ..... 439/677
2002/0146114 A1 * 10/2002 Kameya et al. ..... 379/433.05

* cited by examiner

*Primary Examiner*—James R. Harvey

(57) ABSTRACT

A modular jack connector has an anti-mismating element for preventing incorrect insertion of smaller sized plug connectors. The modular jack connector includes all insulating housing, an insulating terminal seat disposed in the insulating housing, a plurality of contacts disposed in the insulating terminal seat, and two metal anti-mismating elements. One end of each anti-mismating element is fixed to the insulating terminal seat, and the other end is bifurcated with an inner bifurcation bent downward and vertically to form a stopper and an outer bifurcation extending forward and downward to form an inclined guide. The distance between the two stoppers of the two anti-mismating elements is smaller than that between the two inclined guides and equals the width of the smaller sized plug connector. A smaller sized plug connector cannot contact the inclined guides and are blocked by two stoppers to avoid incorrect insertion while it is inserted.

3 Claims, 4 Drawing Sheets

MODULAR JACK CONNECTOR HAVING ANTI-MISMATING ELEMENT

BACKGROUND OF THE INVENTION

1. Field of the Invention

The present invention relates generally to a modular jack connector, and especially, to a network modular jack connector having anti-mismating element for preventing incorrect insertion of smaller sized plug connectors.

2. The Related Art

Today, communication network is popularized and easily available. Consequently, network connectors are widespread for connecting various electronic devices, such as modems, telephones, computers, etc. to the communication network. There is a family of the network connectors that is commonly called modular connector having a similar shape, but with different sizes, widths or numbers of electrical contacts. RJ-11 and RJ-45 modular connectors, for example, are members of the family.

RJ-11 modular jack and modular plug connectors having four electrical contacts respectively are mated to be commonly used for connecting telephones to the communication network. While RJ-45 modular jack and modular plug connectors having eight electrical contacts respectively are mated and commonly used for connecting computers to the communication network. However, RJ-45 modular jack and modular plug connectors have larger dimensions than RJ-11 modular jack and modular plug connectors. Therefore, an RJ-11 modular plug connector or any smaller sized RJ plug connector may be inadvertently inserted into an RJ-45 modular jack connector. Especially, when the RJ-11 modular jack connector and the RJ-45 modular jack connector are disposed side by side, this is more incidental. Once the RJ-11 modular plug connector is inserted into the RJ-45 modular jack connector without care, the expected electrical connection and functioning will not occur, but followed with unexpected electrical or mechanical damage. What is desired is a modular jack connector designed to prevent incorrect insertion of smaller sized plug connectors.

SUMMARY OF THE INVENTION

This invention provides a modular jack connector having an anti-mismating element to prevent an improper insertion of a smaller sized plug connector. The modular jack connector comprises an insulating housing, an insulating terminal seat disposed in the insulating housing, a plurality of contacts, a shielding shell for covering the insulating housing and two metal anti-mismating elements. The insulating housing has a front mating portion and a receiving cavity defined in the front mating portion. Two metal anti-mismating elements are mounted to two opposite sides of the insulating housing terminal seat. An end portion of each anti-mismating element is fixed to the insulating housing terminal seat, and the other end portion of each anti-mismating element extends into the receiving cavity. A free end of the other end portion is bifurcated with an inner bifurcation bent downward and vertically to form a stopper and an outer bifurcation extending forward and downward to form an inclined guide. The distance between the two stoppers is smaller than that between the two inclined guides and equals the width of the smaller sized plug connector.

As described above, when the smaller sized plug connector is inserted into the modular jack connector, because the width of the smaller sized plug connector is smaller than the distance between the two inclined guides, the smaller sized plug connector cannot contact the two inclined guides and is blocked by the two stoppers, thus an incorrect mating is avoided.

The above-mentioned and other features and objects of this invention and the manner of attaining them will become more apparent and the invention itself will be better understood by reference to the following description of a preferred embodiment of the invention taken in conjunction with the accompanying figures, wherein:

DETAILED DESCRIPTION OF THE PREFERRED EMBODIMENT

Figure 1:
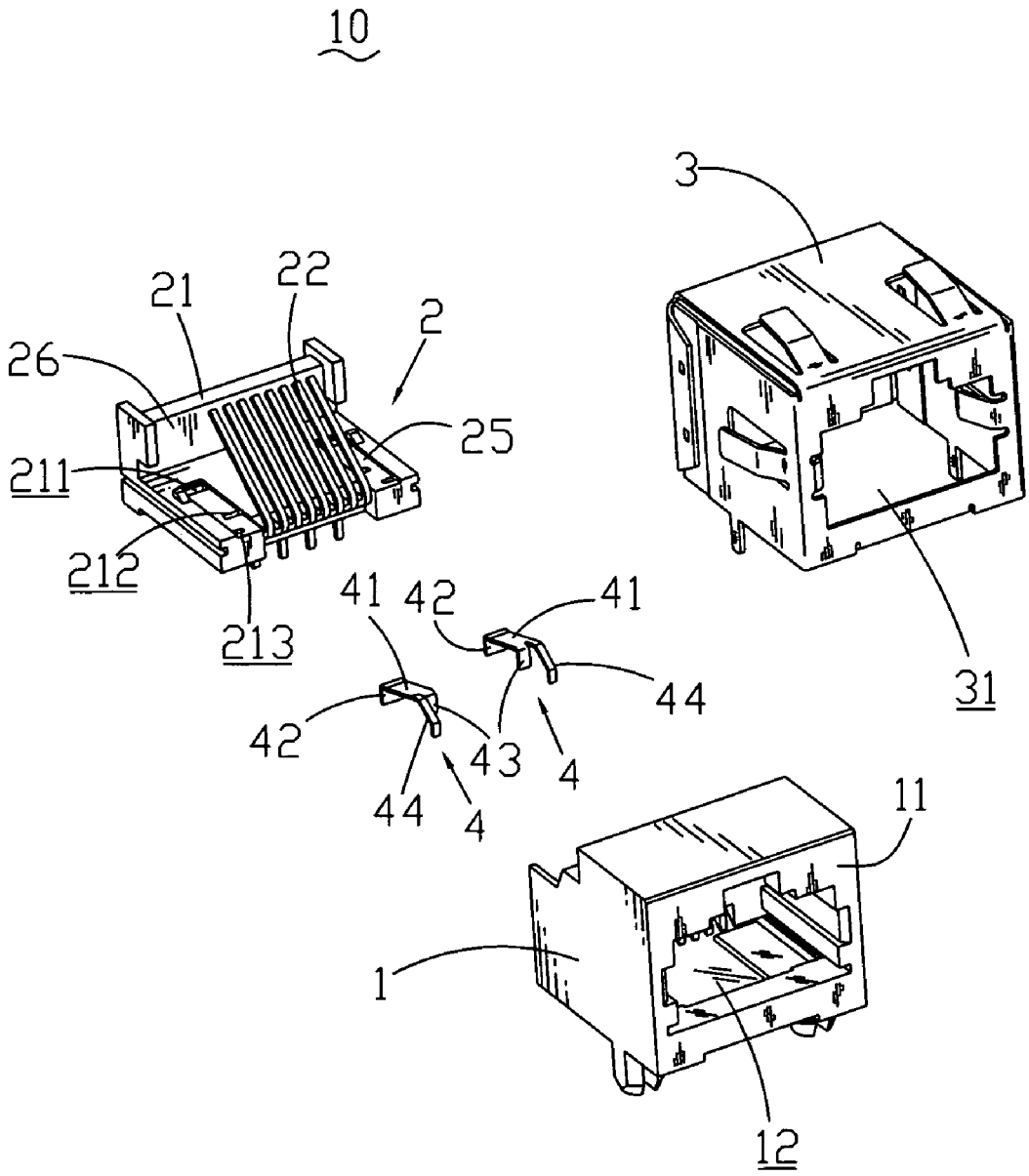
FIG. 1 is an exploded perspective view of a modular jack connector according to the present invention.

Referring to FIG. 1, a modular jack connector 10 is commonly made of clear molded plastic. The modular jack connector 10 is a network connector. In order to describe clearly and concisely, the modular jack connector 10 is shown as an RJ-45 jack connector in following descriptions. The modular jack connector 10 comprises an insulating housing 1 and an L-shaped insulating terminal seat 21. The insulating housing 1 has a front mating portion 11. A receiving cavity 12 is defined in the front mating portion 11. The L-shaped insulating terminal seat 21 has a horizontal base 25 and a vertical shoulder 26 that extends upward from a rear portion of the horizontal base 25. The insulating terminal seat 21 is disposed in the receiving cavity 12 of the insulating housing 1. A plurality of contacts 22 is disposed in the horizontal base 25 of the insulating terminal seat 21 and extends into the receiving cavity 12. A shielding shell 3 is covered on the insulating housing 1, and an opening 31 is defined in a front face of the shielding shell 3 to align with the entry of the receiving cavity 12 while the shielding shell 3 is assembled with the insulating housing 1.

The modular jack connector 10 further comprises two metal anti-mismating elements 4 disposed in the receiving cavity 12 of the insulating housing 1. In this preferred embodiment, the two anti-mismating elements 4 are respectively mounted at two opposite sides of the horizontal base 25 of the insulating housing seat 21, alternatively, the anti-mismating elements 4 can also be mounted at one side of the horizontal base 25, or otherwise, are mounted at a bottom side or at a top side of the insulating housing 1.

Each anti-mismating element 4 comprises a horizontal base portion 41. One end of the base portion 41 is bent downward to form a vertical mounting tab 42, and the other end of the base portion 41 extends forward and is bifurcated with an inner bifurcation bent downward and vertically to form a stopper 43 and an outer bifurcation extending forward and downward to form an inclined guide 44.

Two mounting troughs 211 are defined in the horizontal base 25 of the insulating terminal base 21, and corresponding to the stoppers 43 and the inclined guides 44, two receiving troughs 212 and two guiding troughs 213 are respectively defined in a front portion of the horizontal base 25. While assembling the anti-mismating element 4 with the insulating terminal seat 21, the mounting tabs 42 are engaged with the two mounting troughs 211 and fixed therein, the tip ends of the two stoppers 43 are received in the receiving troughs 212, and the tip ends of the inclined guides 44 are inserted into the guiding troughs 213. The distance between the two stoppers 43 is smaller than that between the two inclined guides 44.

Figure 2:
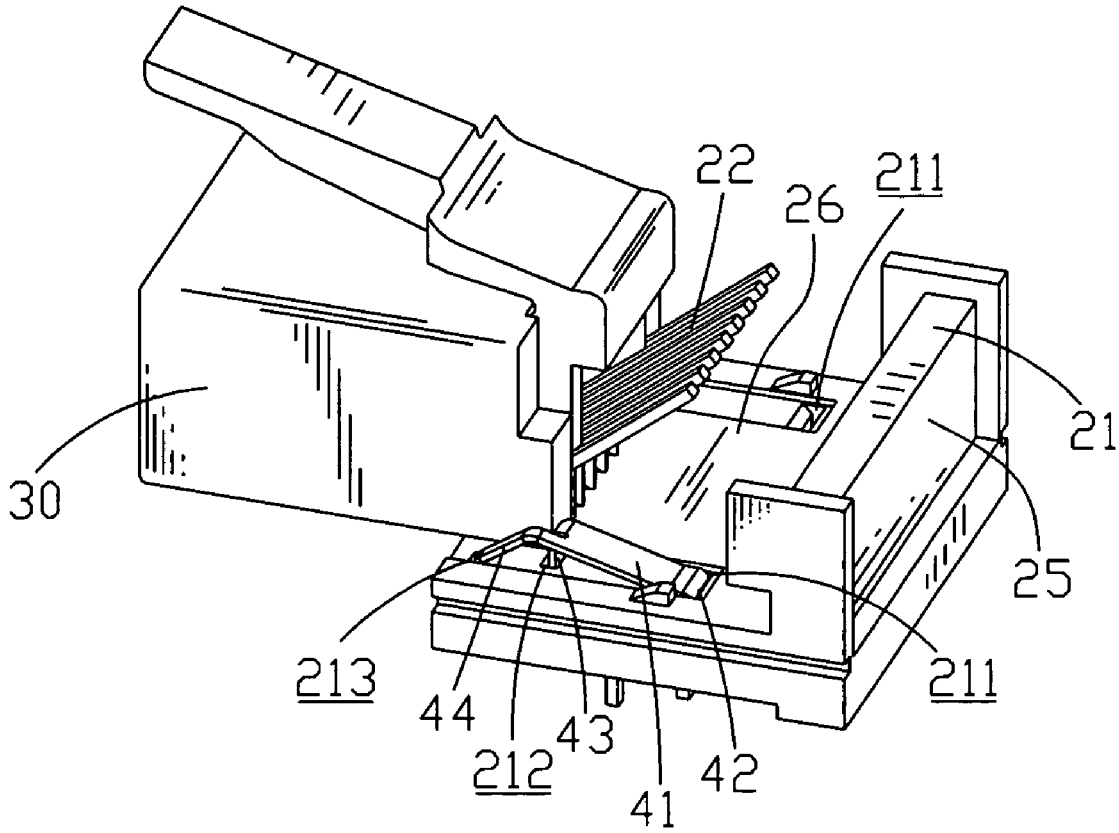
FIG. 2 illustrates an incorrect insertion of a smaller sized plug connector into the modular jack connector according to the present invention.

Referring to FIG. 2 again, FIG. 2 illustrates a smaller sized plug connector being inserted into the modular jack connector 10. The smaller sized plug connector is a RJ-11 telephone plug connector 30. Because the distance between the two inclined guides 44 is bigger than the width of the telephone plug connector 30, the telephone plug connector 30 cannot contact the two inclined guides 44 and are blocked by the two stoppers 43 while being inserted into the receiving cavity 12 of the insulating housing 1. The telephone plug connector 30 cannot be further inserted into the receiving cavity 12 of the modular jack connector 10 to avoid incorrect insertion.

Figure 3:
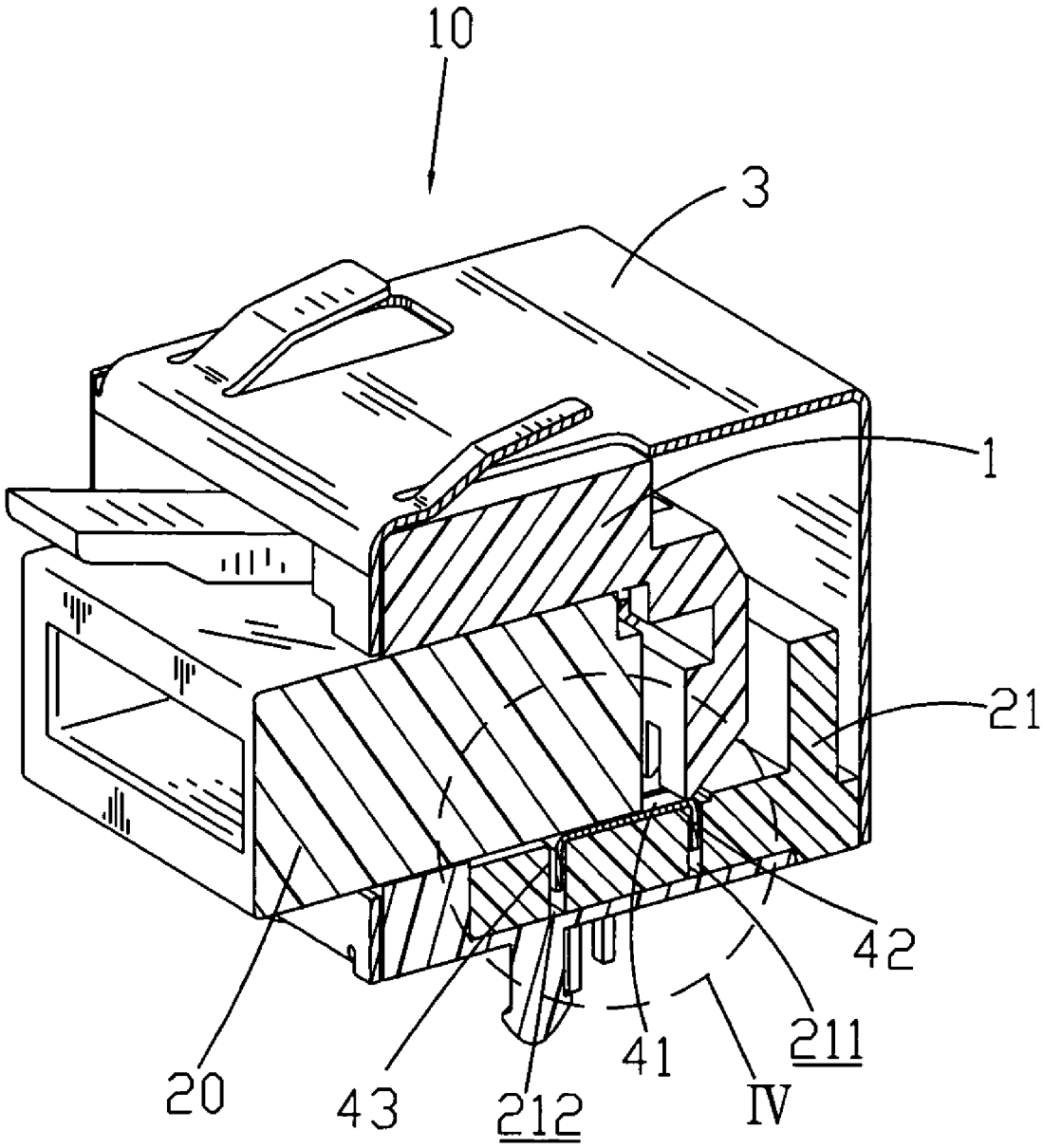
FIG. 3 illustrates a correct insertion of a full sized plug connector into the modular jack connector.
Figure 4:
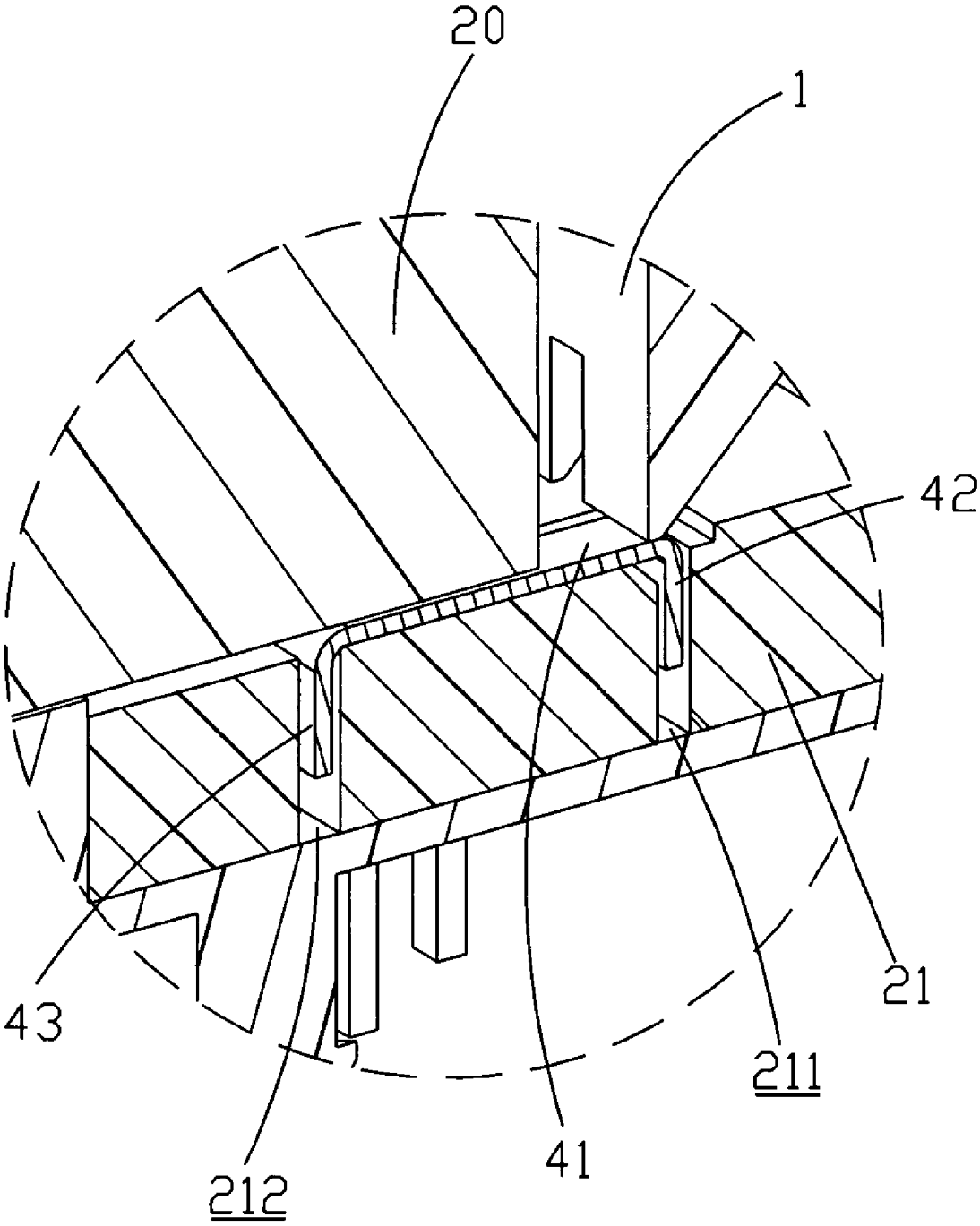
FIG. 4 is an enlarged view of the encircled part IV of FIG. 3.

FIG. 3 and FIG. 4 illustrate a correct insertion of a mated RJ-45 plug connector 20. The RJ-45 plug connector 20 has the same width of the distance between the two inclined guides 44. So the RJ-45 plug connector 20 presses and slides along the two inclined guides 44. While the RJ-45 plug connector 20 is further inserted into the receiving cavity 12 of the insulating housing 1, the RJ-45 plug connector 20 exerts a pressure force upon the inclined guides 44. The inclined guides 44 bear the pressure force so as to deform downward and are received in the guiding troughs 213, in the meanwhile, the stoppers 43 that are integral with the inclined guides 44 also go downward all the way into the receiving trough 212, therefore, the mated RJ-45 plug connector 20 is successfully inserted into the receiving cavity of the modular jack 10 without being blocked by the stoppers 43.

With this improved modular jack 10, the smaller sized telephone plug connector 30 will still go a part of the way into the receiving cavity 12 of the modular jack 10 before it is blocked by the stoppers 43, but it will tend to fall out as soon as users release it, giving an attention to users that something is not correct. So users will check whether the plug connector is mated with the modular jack 10 and then perform a correction. Conversely, a mated RJ-45 plug connector 20 moves along and presses the two inclined guides 44 downward so as to press down two stoppers 43 downward all the way, then the RJ-45 plug connector 20 successfully passes two stoppers 43 and is properly located in the receiving cavity 12 of the modular jack connector 10.

Accordingly, there has been disclosed a modular jack connector capable of preventing an incorrect insertion of a smaller sized plug connector. While an illustrative embodiment of this invention has been disclosed herein, it is understood that various modifications and adaptations to the disclosed embodiment are possible, and it is intended that this invention be limited only by the scope of the appended claims.

What is claimed is:

1. A modular jack connector capable of preventing incorrect insertion of a smaller sized plug connector, comprising:

an insulating housing having a front mating portion and a receiving cavity defined in the front mating portion;

an insulating terminal seat disposed in the insulating housing, the insulating terminal seat having a horizontal base and a vertical shoulder extending upward from a rear portion of the horizontal base;

a plurality of contacts disposed in the insulating terminal seat and extending into the receiving cavity;

a shielding shell for covering the insulating housing; and two metal anti-mismating elements mounted to two opposite sides of the insulating terminal seat, each anti-mismating element having a first end portion fixed to the insulating terminal seat and a second end portion extending into the receiving cavity, a free end of the second end portion being bifurcated with an inner bifurcation bent downward and vertically to form a stopper and an outer bifurcation extending forward and downward to form an inclined guide, the distance between the two stoppers of the two anti-mismating elements being smaller than that between the two inclined guides and equaling the width of the smaller sized plug connector;

wherein a receiving trough and a guiding trough are defined in each of two opposite sides on a front portion of the horizontal base, the two stoppers are received in the two receiving troughs, and the two inclined guides are received in the two guiding troughs.

2. The modular jack connector as claimed in claim 1, wherein two mounting troughs are defined in two opposite sides of the horizontal base, and the two anti-mismating elements each respectively form a mounting tab engaging with the respective mounting trough.

3. The modular jack connector as claimed in claim 1, wherein said smaller sized plug connector is an RJ-11 plug connector.

* * * * *